US007431744B2

(12) United States Patent
Sugita et al.

(10) Patent No.: US 7,431,744 B2
(45) Date of Patent: Oct. 7, 2008

(54) APPARATUS AND METHOD FOR MANUFACTURING SOLID FUEL WITH LOW-RANK COAL

(75) Inventors: Satoru Sugita, Takasago (JP); Tetsuya Deguchi, Takasago (JP); Takuo Shigehisa, Takasago (JP); Shinichi Katsushima, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 633 days.

(21) Appl. No.: 10/971,107

(22) Filed: Oct. 25, 2004

(65) Prior Publication Data

US 2005/0097814 A1 May 12, 2005

(30) Foreign Application Priority Data

Nov. 7, 2003 (JP) ..... 2003-378504

(51) Int. Cl.
*C10L 1/10* (2006.01)
*C10L 5/00* (2006.01)

(52) U.S. Cl. ..... 44/282; 44/626

(58) Field of Classification Search ..... 44/282, 44/626

See application file for complete search history.

(56) References Cited

U.S. PATENT DOCUMENTS 2,430,085 A * 11/1947 Spencer et al. ..... 241/17
3,985,516 A * 10/1976 Johnson et al. ..... 44/501
4,057,399 A 11/1977 Cole et al.
4,309,192 A 1/1982 Kubo et al.
4,514,912 A 5/1985 Janusch et al.
4,705,533 A 11/1987 Simmons
4,800,015 A 1/1989 Simmons
5,035,721 A 7/1991 Atherton
5,256,169 A 10/1993 Roe
5,554,201 A 9/1996 Yagaki et al.
5,556,436 A 9/1996 Yagaki et al.
5,830,246 A 11/1998 Dunlop
5,830,247 A 11/1998 Dunlop
5,858,035 A 1/1999 Dunlop
5,904,741 A 5/1999 Dunlop

FOREIGN PATENT DOCUMENTS

DE 44 46 401 A1 6/1995
JP 7-233383 9/1995

* cited by examiner

*Primary Examiner*—Cephia D Toomer
(74) *Attorney, Agent, or Firm*—Oblon, Spivak, McClelland, Maier & Neustadt, P.C.

(57) ABSTRACT

A method for manufacturing a solid fuel includes the steps of partially or completely separating finely powdered coal from pulverized low-rank coal; mixing the separated low-rank coal with a mixed oil containing a heavy oil and a solvent oil to produce an untreated slurry; heating the untreated slurry to dehydrate the low-rank coal and filling the pores of the low-rank coal with the mixed oil; and separating the solid fuel from the heated slurry by solid-liquid separation. The manufacturing method further includes the step of adding the finely powdered coal separated from the low-rank coal to the solid fuel produced by the solid-liquid separation of the heated slurry. The finely powdered coal separated from the low-rank coal has an average particle size of 0.5 mm or less. An apparatus for the manufacturing method is also disclosed.

4 Claims, 5 Drawing Sheets

APPARATUS AND METHOD FOR MANUFACTURING SOLID FUEL WITH LOW-RANK COAL

BACKGROUND OF THE INVENTION

1. Field of the Invention

The present invention relates to an apparatus and a method for manufacturing a solid fuel with low-rank coal 2. Description of the Related Art A general process for manufacturing a solid fuel with low-rank coal is disclosed in Japanese Unexamined Patent Application Publication No. 7-233383. The process disclosed in the Patent Publication includes the following procedure: Porous coal is mixed with a mixed oil containing a heavy oil and a solvent oil to produce a slurry. Heating the resulting slurry dehydrates the porous coal, and fills the pores of the porous coal with the mixed oil. Next, the slurry is subjected to a solid-liquid separation. Low-rank coal is used as the porous coal.

A solid fuel that can be safely transported and stored due to its low spontaneous combustibility and that also has a high calorific value can be manufactured by the process including dehydration disclosed in the above-described Patent Publication.

Since porous coal (low-rank coal) has a high moisture content, the porous coal causes an increase in transport cost, i.e., a decrease in transport efficiency in proportion to the moisture content, and has a low calorific value. Thus, porous coal is preferably dehydrated. However, when porous coal is dehydrated by a general drying process, there is a danger of a spontaneous combustion accident caused by oxygen adsorption on active sites, which are present in the pores of the dehydrated porous coal, followed by oxidation.

In the above-described process for manufacturing a solid fuel, moisture in the pores is evaporated by heating an untreated slurry composed of porous coal and a mixed oil containing a heavy oil and a solvent oil. At the same time, the inner surfaces of the pores are covered with the mixed oil. Finally, the pores are filled with the mixed oil, in particular, with the heavy oil dominantly. Therefore, the adsorption of oxygen to such active sites in the pores and oxidation are suppressed, thus blocking spontaneous combustion. Furthermore, the resulting solid fuel has a high calorific value because the porous coal is dehydrated and the pores are filled with the mixed oil by heating. In this way, a solid fuel that can be safely transported and stored due to its low spontaneous combustibility and that also has a high calorific value can be manufactured by the process including dehydration.

In the process for manufacturing a solid fuel disclosed in the above-described Patent Publication, porous coal (low-rank coal) pulverized with a pulverizer is used as a material for the untreated slurry. That is, the untreated slurry is produced by mixing the porous coal pulverized with a pulverizer and a mixed oil containing a heavy oil and a solvent oil in a mixing tank.

By heating the untreated slurry, the porous coal is dehydrated, and the pores of the porous coal are filled with the mixed oil. This dehydration by heating is generally performed in an evaporator. In the mixing tank and the evaporator, the slurry state is maintained by circulating the slurry with a slurry pump while stirring, thus preventing the deposition of the coal caused by sedimentation.

After the porous coal is dehydrated and the pores of the porous coal are filled with the mixed oil by heating, the resulting heated slurry (hereinafter, referred to as "dehydrated slurry") is subjected to solid-liquid separation to separate the dehydrated slurry into a solid and a liquid. The resulting solid is composed of porous coal containing the mixed oil in its pores and can be used as a powdered solid fuel. Briquetting the resulting solid produces a briquette solid fuel. The separated liquid that is mainly composed of oil can be recycled as oil used to produce an untreated slurry. That is, the separated liquid that is used as a recycling oil is returned to a step of producing an untreated slurry.

The solid-liquid separation of the dehydrated slurry is performed with, for example, a centrifuge. The separated liquid contains finely powdered coal that was not completely separated from the dehydrated slurry. For example, when the dehydrated slurry is subjected to solid-liquid separation with a decanter centrifuge, fine particles (finely powdered coal) having a diameter of about 50 μm or less are not separated and remain in the separated liquid.

Such a separated liquid is returned to a step of producing an untreated slurry. Hence, the content of finely powdered coal in a recycling oil increases in every cycle, thus reducing the flowability of the untreated slurry. Therefore, the process does not smoothly proceed. If the untreated slurry does not flow, the process stops.

When the solid-liquid separation of the dehydrated slurry is performed with, for example, a distillation unit having an excellent ability for the solid-liquid separation, a separated liquid hardly contains finely powdered coal. The use of the resulting separated liquid as a recycling oil can prevent the reduction in the flowability of the untreated slurry caused by the contamination of finely powdered coal. However, such a unit has disadvantages of the long time required for the separation and being noneconomical due to high operational costs compared with a centrifuge. Therefore, such a unit is difficult to be applied.

SUMMARY OF THE INVENTION

The present invention was accomplished in view of the circumstances. It is an object of the present invention to provide an apparatus and a method for manufacturing a solid fuel with low-rank coal, the apparatus and the method being capable of reducing the content of finely powdered coal in a recycling oil returned to a step of producing an untreated slurry.

The inventors have conducted extensive studies to achieve the object and have accomplished the present invention capable of achieving the object.

The present invention relates to an apparatus and a method for manufacturing a solid fuel with low-rank coal. The present invention includes a method for manufacturing a solid fuel according to first through fourth aspects and an apparatus for manufacturing a solid fuel according to a fifth aspect. These aspects will be described in detail below.

That is, according to a first aspect of the present invention, a method for manufacturing a solid fuel includes the steps of partially or completely separating finely powdered coal from pulverized low-rank coal; mixing the separated low-rank coal with a mixed oil containing a heavy oil and a solvent oil to produce an untreated slurry; heating the untreated slurry to dehydrate the low-rank coal and filling the pores of the low-rank coal with the mixed oil; and separating the solid fuel from the heated slurry by solid-liquid separation.

According to a second aspect of the present invention a method for manufacturing a solid fuel according to the first aspect further includes the step of adding the finely powdered coal separated from the low-rank coal to the solid fuel produced by the solid-liquid separation of the heated slurry.

According to a third aspect of the present invention in the method for manufacturing a solid fuel according to the first aspect, the finely powdered coal separated from the low-rank coal has an average particle size of 0.5 mm or less.

According to a fourth aspect of the present invention in the method for manufacturing a solid fuel according to the first aspect, the finely powdered coal is separated from the low-rank coal with a cyclone.

According to a fifth aspect of the present invention an apparatus for manufacturing a solid fuel includes a separating unit for partially or completely separating finely powdered coal from pulverized low-rank coal; a mixing unit for mixing the low-rank coal separated from the finely powdered coal with a mixed oil containing a heavy oil and a solvent oil to produce an untreated slurry; an evaporating unit for dehydrating the untreated slurry by heating; and a solid-liquid separating unit for subjecting the dehydrated slurry to solid-liquid separation.

According to a method for manufacturing a solid fuel of the present invention, the content of a finely powdered coal in a recycling oil returned to a step of producing an untreated slurry can be reduced. An apparatus for manufacturing a solid fuel of the present invention can employ the method for manufacturing a solid fuel and can reduce the content of finely powdered coal in a recycling oil returned to a step of producing an untreated slurry.

DESCRIPTION OF THE PREFERRED EMBODIMENTS

Figure 1:
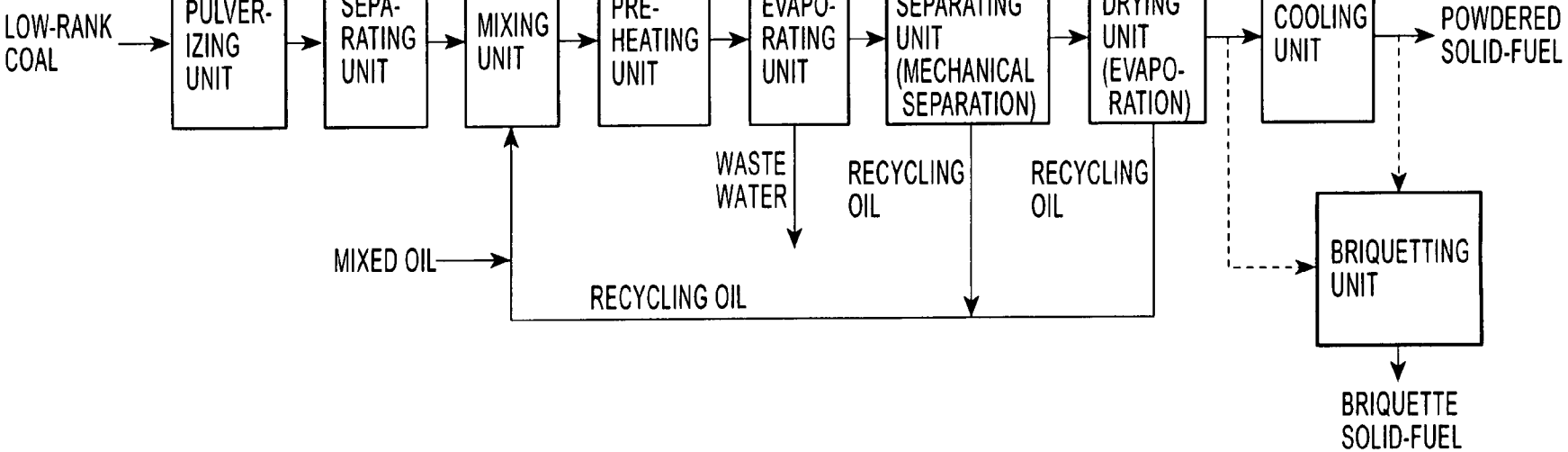
FIG. 1 is a process flow chart of Embodiment 1 according to a method for manufacturing a solid fuel of the present invention.

A method for manufacturing a solid fuel includes the steps of partially or completely separating finely powdered coal from pulverized low-rank coal; mixing the separated low-rank coal with a mixed oil containing a heavy oil and a solvent oil to produce an untreated slurry; heating the untreated slurry to dehydrate the low-rank coal and filling the pores of the low-rank coal with the mixed oil; and separating the solid fuel from the heated slurry by solid-liquid separation.

The pulverized low-rank coal is not mixed on an as-is basis. After the finely powdered coal is partially or completely separated from the pulverized low-rank coal, the resulting pulverized low-rank coal is mixed with the mixed oil.

By heating the untreated slurry, the porous coal is dehydrated, and the pores of the porous coal are filled with the mixed oil. A liquid separated (hereinafter, referred to as "separated liquid") by subjecting the resulting heated slurry (hereinafter, referred to as "dehydrated slurry") to the solid-liquid separation contains no finely powdered coal or contains a very small amount of finely powdered coal. Such a separated liquid can be used as a recycling oil and can be returned to a step of producing an slurry.

Therefore, according to a method for manufacturing a solid fuel of the present invention the content of the finely powdered coal in the recycling oil returned to the step of producing an untreated slurry can be reduced. Furthermore, the flowability of an untreated slurry is hardly reduced by finely powdered coal in a recycling oil, and the process is thus hardly stopped by the reduction in the flowability of the untreated slurry.

It is preferable to add finely powdered coal separated from the low-rank coal to a solid fuel produced by the solid-liquid separation of the heated slurry (second aspect). The added finely powdered coal can cool the solid fuel to a stable temperature of the solid fuel. In addition, this method has an advantage that the added finely powdered coal can also be used as a fuel. Further details about this method will be described below.

A solid fuel produced by subjecting the heated slurry to solid-liquid separation has a temperature of about 150° C. and is thus unstable due to its high activity; hence, a cooling unit is required for the solid fuel. The cooling unit employs air cooling or water cooling and uses a coolant.

On the other hand, adding the finely powdered coal separated from the low-rank coal to the solid fuel can cool the solid fuel to a temperature (100° C. or less) at which the spontaneous generation of heat by oxidation does not occur. Hence, the cooling unit is not necessary. Furthermore, the finely powdered coal can be used as a fuel.

Finely powdered coal separated from the low-rank coal preferably has an average particle size of 0.5 mm or less (third aspect). Such a separation surely reduces the content of finely powdered coal in a separated liquid produced by subjecting a dehydrated slurry to solid-liquid separation. As a result, the content of finely powdered coal in a recycling oil returned to a step of producing an untreated slurry can surely be reduced.

When finely powdered coal having an average particle size of 0.5 mm or less is separated, the majority of finely powdered coal is separated. When finely powdered coal having an average particle size of 0.05 mm or less is separated, finely powdered coal having an average particle size of more than 0.05 mm is not an object of the separation. In this case, the least amount of finely powdered coal is separated. In theory, the finely powdered coal having an average particle size of more than 0.05 mm is not included in the separated finely powdered coal having an average particle size of 0.05 mm or less.

Therefore, when finely powdered coal having an average particle size of 0.05 mm or less is separated, the finely powdered coal having an average particle size of more than 0.05 mm is included in an untreated slurry and is thus included in a dehydrated slurry. As a result, the finely powdered coal having an average particle size of more than 0.05 mm is also included in a separated liquid produced by subjecting the dehydrated slurry to solid-liquid separation On the other hand, when finely powdered coal having an average particle size of 0.5 mm or less is separated, since the majority of finely powdered coal is separated, an untreated slurry has a low content of finely powdered coal and a dehydrated slurry has thus a low content of finely powdered coal. Therefore, a separated liquid produced by subjecting the dehydrated slurry to solid-liquid separation has a low content of finely powdered coal. As a result, the content of finely powdered coal in a recycling oil returned to a step of producing an untreated slurry can be reduced.

In view of the reduction of the content of finely powdered coal in a recycling oil, finely powdered coal having an average particle size of 0.5 mm or less is preferably separated. However, in this case, an amount of solid fuel produced by subjecting a dehydrated slurry to solid-liquid separation is reduced. In consideration of this point, finely powdered coal having an average particle size of 0.1 mm or less is preferably separated.

Finely powdered coal in a pulverized low-rank coal can be separated with, but are not limited various devices such as dry classifiers and wet classifiers. The dry classifiers include, for example, screening machines, gravitational classifiers, centrifugal classifiers, and inertial classifiers. The wet classifiers include, for example, settling classifiers, hydraulic classifiers, mechanical classifiers, and centrifugal classifiers. An example of the centrifugal classifiers among the dry classifiers is a cyclone classifier. This cyclone classifier can separate finely powdered coal having an average particle size of 0.1 mm or less (fourth aspect).

The solid-liquid separation of the dehydrated slurry can be performed with, but is not limited, various devices such as centrifuges, expression equipment, settlers, and filters. A separated liquid produced by subjecting dehydrated slurry to solid-liquid separation with such a device has a low content of finely powdered coal. As a result, the content of finely powdered coal in a recycling oil returned to a step of producing an untreated slurry can be reduced. A unit, for example, a distillation unit having an excellent ability for the solid-liquid separation has disadvantages of the long time required for the solid-liquid separation and being noneconomical due to high operational costs compared with a centrifuge. Such a unit is inappropriate because such a unit lowers the value of the present invention.

The term "low-rank coal" means coal which has a high moisture content and which is preferably dehydrated. Examples of such low-rank coal include, but are not limited to, lignite and sub-bituminous coal. The lignite includes, for example, Victorian lignite, North Dakota lignite, and Berga lignite. The sub-bituminous coal includes, for example, West Banko coal and Binungan coal.

The term "finely powdered coal" means powdered coal that has an average particle size of 1 mm or less. The average particle size of finely powdered coal is measured with a standard screen according to Japan Industrial Standards (JIS) Z-8801 (1976) by a screening process according to JIS R-6002 (1978).

The term "heavy oil" means a heavy fraction, for example, a residual oil that substantially has no vapor pressure at, for example, 400° C. or oil containing the heavy fraction.

Figure 2:
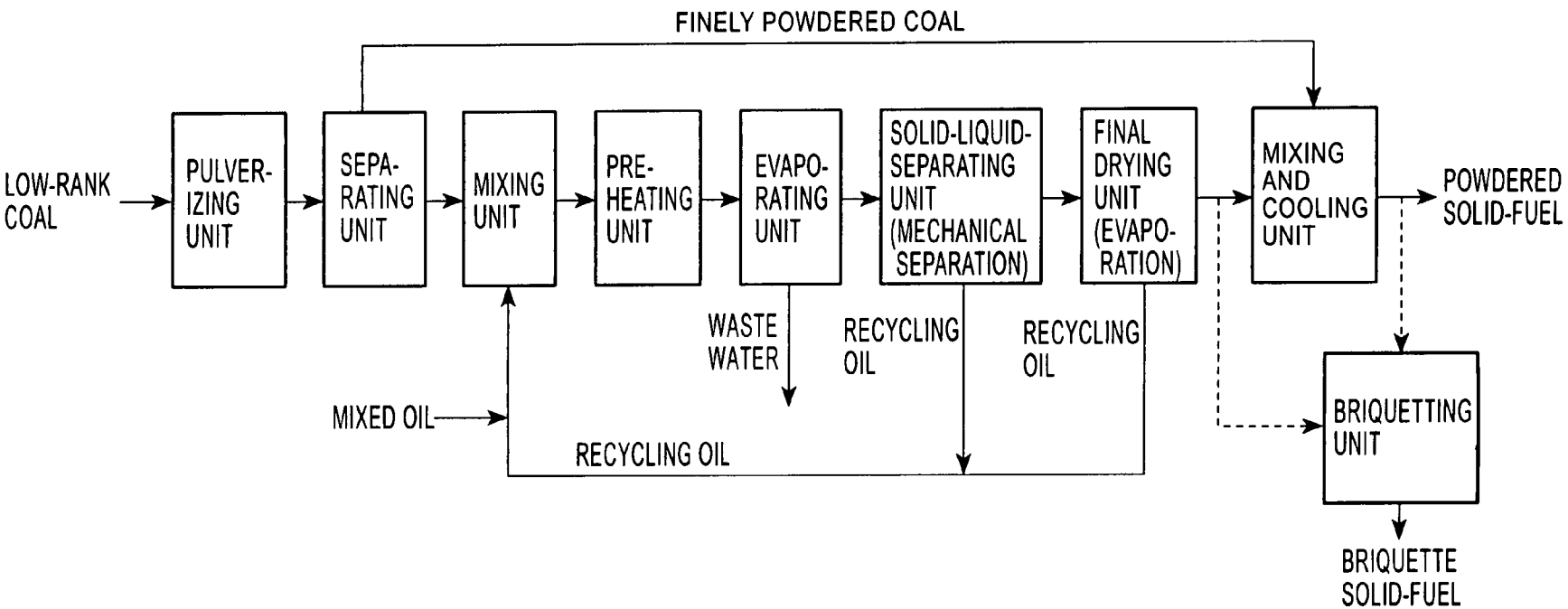
FIG. 2 is a process flow chart of Embodiment 2 according to a method for manufacturing a solid fuel of the present invention.
Figure 3:
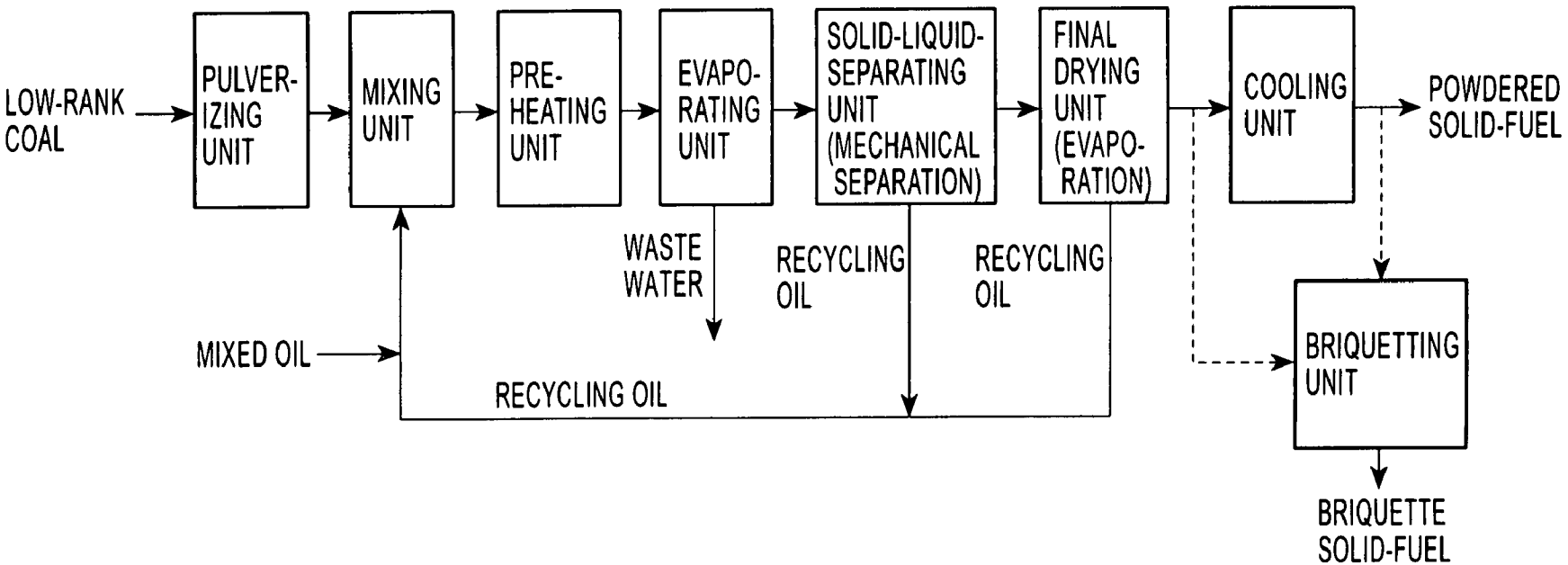
FIG. 3 is a process flow chart of an embodiment according to a conventional method for manufacturing a solid fuel disclosed in Japanese Unexamined Patent Application Publication No. 7-233383.

FIGS. 1 and 2 show Embodiment 1 and 2 of methods for manufacturing a solid fuel according to the present invention. FIG. 3 shows a conventional embodiment of a known method for manufacturing a solid fuel disclosed in Japanese Unexamined Patent Application Publication No. 7-233383.

In the conventional embodiment shown in FIG. 3, low-rank coal is pulverized in a pulverizing unit and mixed with a mixed oil containing a heavy oil and a solvent oil to produce an untreated slurry. This resulting slurry is preheated in a preheating unit and heated in an evaporating unit to produce a dehydrated slurry. At the same time, the pores of the low-rank coal are filled with the mixed oil. The resulting dehydrated slurry is subjected to solid-liquid separation in both a solid-liquid separating unit and a final drying unit, thus resulting in a solid and a liquid. The resulting liquid is used as a recycling oil and returned to a step of producing an untreated slurry. The resulting solid is cooled in a cooling unit, thus resulting in a powdered solid fuel. Alternatively, after cooling in the cooling unit, the resulting solid is briquetted in a briquetting unit to produce a briquette solid fuel.

In Embodiment 1 of the present invention shown in FIG. 1, low-rank coal is pulverized in a pulverizing unit, and then finely powdered coal is separated and removed in a separating unit. The resulting low-rank coal in which the finely powdered coal was removed is mixed with a mixed oil containing a heavy oil and a solvent oil to produce an untreated slurry. The following process is performed as in the same way as for the conventional embodiment shown in FIG. 3.

In Embodiment 2 shown in FIG. 2, a process is performed as in the Embodiment 1 shown in FIG. 1, but finely powdered coal separated from low-rank coal in a separating unit is mixed with a solid, which is produced by subjecting a dehydrated slurry to solid-liquid separation in a mixing and cooling unit. That is, the solid is cooled by the addition of the finely powdered coal in the mixing and cooling unit, thus resulting in a solid fuel. Alternatively, after cooling in the cooling unit, the resulting solid is briquetted in briquetting unit to produce a briquette solid fuel.

Figure 4:
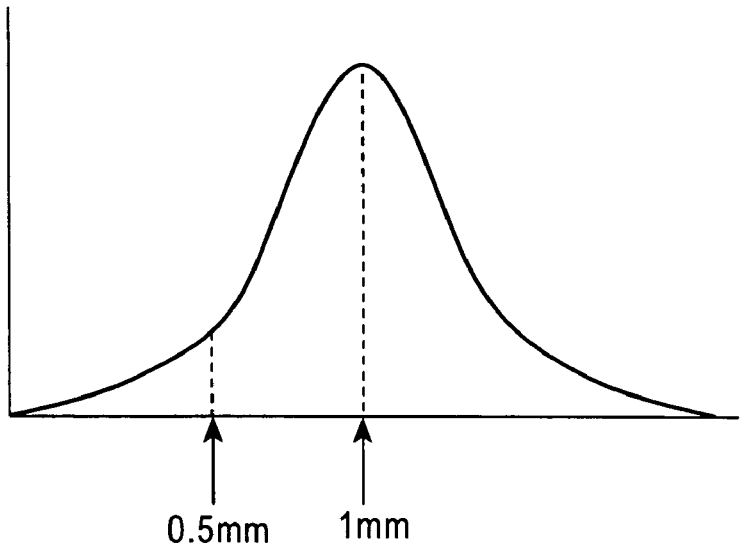
FIG. 4 is a schematic view showing a particle size distribution of a pulverized coal having an average particle size of 1 mm.
Figure 5:
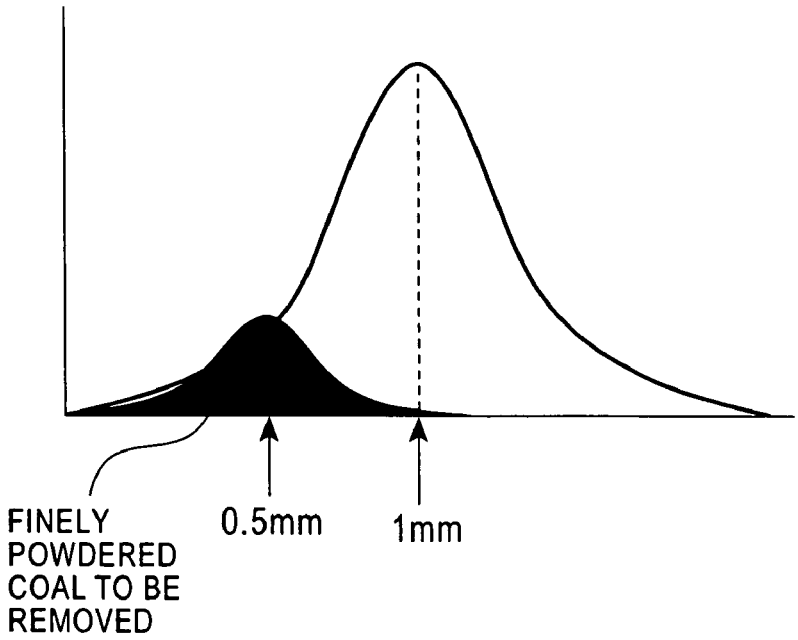
FIG. 5 is a schematic view showing particle size distributions of pulverized coal having an average particle size of 1 mm and of finely powdered coal having an average particle size of 0.5 mm.
Figure 6:
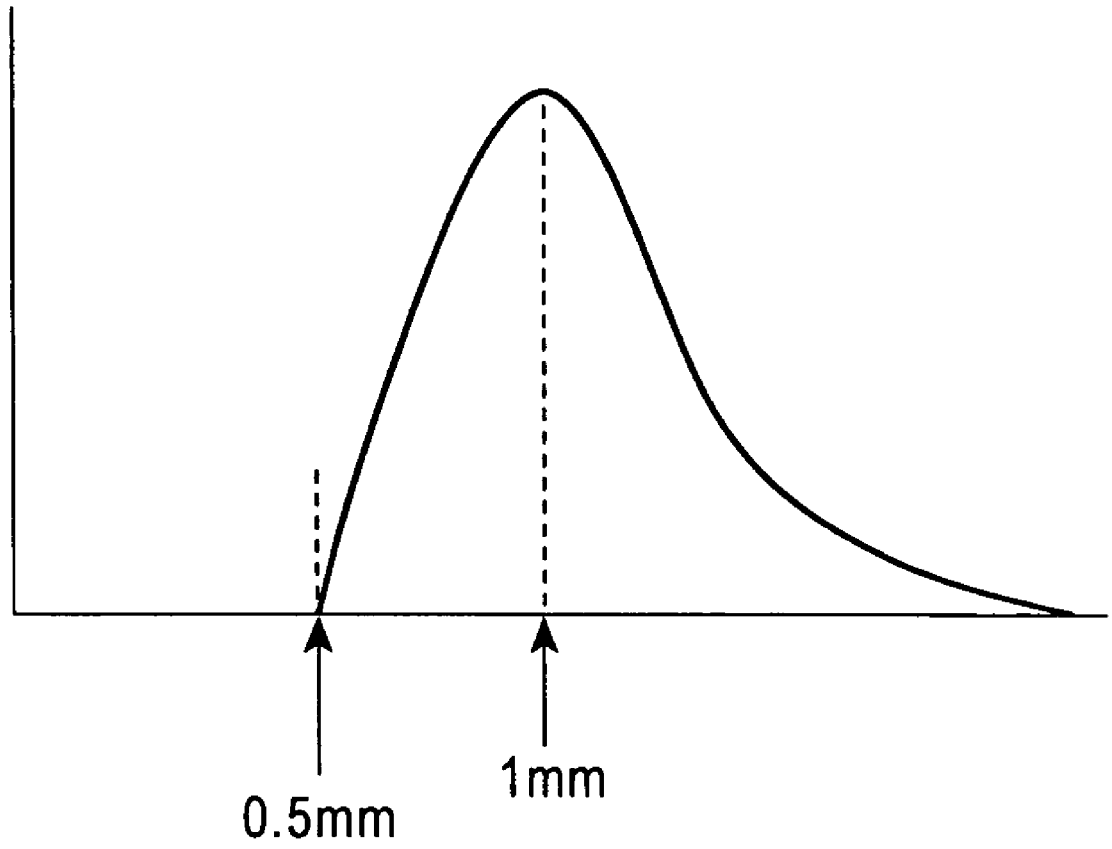
FIG. 6 is a schematic view showing a particle size distribution of the remaining pulverized coal after removing finely powdered coal having a diameter of 0.5 mm or less from the pulverized coal having an average particle size of 1 mm.

FIG. 4 shows the particle size distribution of powdered coal having an average particle size of 1 mm. When finely powdered coal having an average particle size of 0.5 mm is separated (removed) from the powdered coal having an average particle size of 1 mm, the particle size distribution of the finely powdered coal to be removed is represented by the solidly shaded area in FIG. 5. FIG. 6 shows the particle size distribution of the resulting powdered coal in which the finely powdered coal was removed.

A separated liquid contains finely powdered coal even when finely powdered coal is completely removed from a pulverized low-rank coal This is because finely powdered coal is newly formed in mixing a low-rank coal with a mixed oil and/or in solid-liquid separation. The finely powdered coal that is newly formed is not entirely moved into the separated liquid, but much of the newly-formed finely powdered coal is present in a separated solid such as a cake.

Removing finely powdered coal from a pulverized low-rank coal reduces the content of finely powdered coal in a separated liquid. For example, as shown in Table 1, when finely powdered coal is not removed, returning a separated liquid, which is used as a recycling oil, to a step of producing an untreated slurry increases the content of finely powdered coal having a particle size of 50 μm or less in the recycling oil in every cycle. On the other hand, for example, as shown in Table 2, when finely powdered coal is removed, the content of finely powdered coal having a particle size of 50 μm or less in the recycling oil is not increased and is maintained at a low level even when the cycle is repeated.

To achieve the effect of removing finely powdered coal, in other words, to prevent the reduction of flowability of a slurry due to finely powdered coal, for example, at least 90 percent by weight of finely powdered coal having an average particle size of 0.1 mm or less is preferably removed. In this case, the effect is achieved at a high level.

As described above, an apparatus for manufacturing a solid fuel includes a separating unit for partially or completely separating finely powdered coal from pulverized low-rank coal; a mixing unit for mixing the low-rank coal separated from the finely powdered coal with a mixed oil containing a heavy oil and a solvent oil to produce an untreated slurry; an evaporating unit for dehydrating the untreated slurry by heating; and a solid-liquid separating unit for subjecting the dehydrated slurry to solid-liquid separation (fifth aspect). The apparatus for manufacturing a solid fuel of the present invention can employ the method for manufacturing a solid fuel and can reduce the content of finely powdered coal in a recycling oil returned to a step of producing an untreated slurry. For example, FIGS. 1 and 2 show the embodiments of the apparatus.

EXAMPLES

EXAMPLES of the present invention will be described below. The present invention is not limited to these EXAMPLES. The present invention can be modified within the scope of the present invention. The modifications are technically included in the scope the present invention.

Example 1

Binungan Block 7 (hereinafter, referred to as "Binungan coal") produced in Indonesia was used as low-rank coal and was pulverized with a hammer crusher to produce a pulverized coal having a maximum particle size of 3 mm or less and having an average particle size of about 0.5 mm.

Next, finely powdered coal having an average particle size of about 0.1 mm or less was separated from the pulverized low-rank coal with a cyclone. The separated finely powdered coal was about 10 percent by mass (percent by weight) of the pulverized low-rank coal.

The separated low-rank coal was mixed with a mixed oil containing kerosene and asphalt to produce an slurry. The kerosene was functioning as a solvent oil, and the asphalt was functioning as a heavy oil. The mixed oil had an asphalt content of 0.5 percent by weight (percent by mass). The weight ratio of the mixed oil to the low-rank coal was 1.7 on the basis of the weight of the dried low-rank coal Since low-rank coal used contains moisture, the reduced weight of low-rank coal when dried was used for the calculation of the weight ratio. That is, the weight ratio of (the mixed oil)/(the dried low-rank coal) was 1.7.

The resulting slurry was heated in a evaporating unit to dehydrate the low-rank coal. At this time, the pores of the low-rank coal were filled with the mixed oil containing kerosene and asphalt.

The dehydrated slurry was subjected to solid-liquid separation with a decanter centrifuge (corresponding to the solid-liquid separating unit in FIG. 1) at a centrifugal force of 2000 G. As a result, a cake, which was in the form of mud containing the mixed oil, and a separated liquid was produced.

The separated liquid can be used as a recycling oil used in a step of producing an untreated slurry. The cake can be used as a solid fuel after removing a solvent oil with a steam tube dryer (corresponding to the final drying unit in FIG. 1).

Comparative Example 1

A process was performed as in EXAMPLE 1, but without the separation of finely powdered coal.

The separated liquid can be used as a recycling oil used in a step of producing an slurry. The cake can be used as a solid fuel after removing a solvent oil with a steam tube dryer. The content of the finely powdered coal in the separated liquid was about 5 percent by mass.

In EXAMPLE 1, it was found the recycling oil (separated liquid) had s low content of finely powdered coal, that is, the content of finely powdered coal in the recycling oil can be significantly reduced compared with that in COMPARATIVE EXAMPLE 1.

Example 2

The finely powdered coal, which has an average particle size of 0.1 mm or less, separated in EXAMPLE 1 was added to the solid (powdered solid fuel), which has a temperature of 150° C., produced by subjecting the dehydrated slurry to solid-liquid separation in EXAMPLE 1. The added amount of finely powdered coal was 9 times (weight ratio) the amount of powdered solid fuel. Although the finely powdered coal used contains moisture, the amount of finely powdered coal that was dried was used for the calculation of the weight ratio. That is, the dried finely powdered coal was 9 times (weight ratio) the powdered solid fuel.

The addition of the finely powdered coal to the powdered solid fuel generates steam. The generated steam substituted for a nitrogen gas.

As a result, the solid (powdered solid fuel) was cooled from 150° C. to 100° C. This solid had thermal stability up to 100° C.

TABLE 1

Content of finely powdered coal having particle size of 50 μm or less in process having no separating step.

| | Number of cycles of oil | | | | |
|---|---|---|---|---|---|
| | 0 | 1 | 2 | 3 | 4 |
| Pulverized coal | 1 | 1 | 1 | 1 | 1 |
| Dehydrated slurry | 8 | 11 | 14 | 17 | 20 |
| Cake | 10 | 10 | 10 | 10 | 10 |
| Separated liquid | 3 | 6 | 9 | 12 | 15 |

(unit: percent by weight on the basis of dried finely powdered coal)

TABLE 2

Content of finely powdered coal having particle size of 50 μm or less in process having separating step.

| | Number of cycles of oil | | | | |
|---|---|---|---|---|---|
| | 0 | 1 | 2 | 3 | 4 |
| Pulverized coal | 1 | 0 | 0 | 0 | 0 |
| Dehydrated slurry | 8 | 8 | 8 | 8 | 8 |
| Cake | 10 | 10 | 10 | 10 | 10 |
| Separated liquid | 3 | 3 | 3 | 3 | 3 |

(unit: percent by weight on the basis of dried finely powdered coal)

In the above-described EXAMPLES and COMPARATIVE EXAMPLE, Binungan coal was used as low-rank coal. When other low-rank coal was used, the results showed different absolute values but had the same tendency as the above-described results.

A mixed oil containing kerosene and asphalt was used as oil mixed with low-rank coal. When other mixed oil was used, provided that the oil contains a heavy oil and a solvent oil, the results showed different absolute values but had the same tendency as the above-described results.

Solid-liquid separation of the dehydrated slurry was performed with a decanter centrifuge at a centrifugal force of 2000 G. When other separators were used, the results showed different absolute values but had the same tendency as the above-described results.

What is claimed is:

1. A method for manufacturing a solid fuel, comprising the steps of:

partially or completely separating finely powdered coal from pulverized low-rank coal, wherein the finely powdered coal has a smaller average particle size than the pulverized low-rank coal;

mixing the separated low-rank coal with a mixed oil containing a heavy oil and a solvent oil to produce an untreated slurry;

heating the untreated slurry to dehydrate the low-rank coal and filling the pores of the low-rank coal with the mixed oil; and separating the solid fuel from the heated slurry by solid-liquid separation.

2. The method for manufacturing a solid fuel according to claim 1, further comprising the step of:

adding the finely powdered coal separated from the low-rank coal to the solid fuel produced by the solid-liquid separation of the heated slurry.

3. The method for manufacturing a solid fuel according to claim 1, wherein the finely powdered coal separated from the low-rank coal has an average particle size of 0.5 mm or less.

4. The method for manufacturing a solid fuel according to claim 1, wherein the finely powdered coal is separated from the low-rank coal with a cyclone.

* * * * *

UNITED STATES PATENT AND TRADEMARK OFFICE

CERTIFICATE OF CORRECTION

PATENT NO. : 7,431,744 B2
APPLICATION NO. : 10/971107
DATED : October 7, 2008
INVENTOR(S) : Sugita et al.

It is certified that error appears in the above-identified patent and that said Letters Patent is hereby corrected as shown below:

On the title page, Item (73), the Assignee information is incorrect. Item (73) should read:

-- (73) Assignee: Kabushiki Kaisha Kobe Seiko Sho (Kobe Steel, Ltd.)
Kobe-shi, (JP) --

Signed and Sealed this

Second Day of December, 2008

JON W. DUDAS
*Director of the United States Patent and Trademark Office*